US007809292B2

(12) United States Patent
Yamaguchi

(10) Patent No.: US 7,809,292 B2
(45) Date of Patent: Oct. 5, 2010

(54) IMAGE FORMING APPARATUS, METHOD, AND COMPUTER PROGRAM PRODUCT, DETECTING TEMPERATURE OF A FIXING UNIT

(75) Inventor: Yasuo Yamaguchi, Hyogo (JP)

(73) Assignee: Ricoh Company, Limited, Tokyo (JP)

( * ) Notice: Subject to any disclaimer, the term of this patent is extended or adjusted under 35 U.S.C. 154(b) by 254 days.

(21) Appl. No.: 12/104,581

(22) Filed: Apr. 17, 2008

(65) Prior Publication Data

US 2008/0305424 A1 Dec. 11, 2008

(30) Foreign Application Priority Data

May 10, 2007 (JP) ..... 2007-125411

(51) Int. Cl.
*G03G 15/20* (2006.01)

(52) U.S. Cl. ..... 399/33

(58) Field of Classification Search ..... 399/33, 399/69, 70, 320

See application file for complete search history.

(56) References Cited

U.S. PATENT DOCUMENTS

2004/0037580 A1 * 2/2004 Ohta ..... 399/69

FOREIGN PATENT DOCUMENTS

| | | |
|---|---|---|
| JP | 02-293883 | * 12/1990 |
| JP | 2001-27863 | 1/2001 |
| JP | 2007-34016 | 2/2007 |

* cited by examiner

*Primary Examiner*—Hoang Ngo
(74) *Attorney, Agent, or Firm*—Oblon, Spivak, McClelland, Maier & Neustadt, L.L.P.

(57) ABSTRACT

A temperature detecting unit detects temperature of a fixing unit, and a control unit monitors temperatures detected by the temperature detecting unit. The control unit determines that the temperature detecting unit is abnormal when a first difference in temperatures in a first time period exceeds a first threshold.

15 Claims, 2 Drawing Sheets

IMAGE FORMING APPARATUS, METHOD, AND COMPUTER PROGRAM PRODUCT, DETECTING TEMPERATURE OF A FIXING UNIT

CROSS-REFERENCE TO RELATED APPLICATIONS

The present application claims priority to and incorporates by reference the entire contents of Japanese priority document 2007-125411 filed in Japan on May 10, 2007.

BACKGROUND OF THE INVENTION

1. Field of the Invention

The present invention relates to an image forming apparatus, an image forming method, and a computer program product.

2. Description of the Related Art

In an image forming apparatus, upon heating a fixing unit with a heater, if expected increase in temperature of the fixing unit is not achieved within a certain time, the thermistor that detects the temperature of the fixing unit is judged to be abnormal. If the thermistor is judged to be abnormal, the operation of the heater is stopped to prevent heating of the fixing unit to an undesirable high temperature. Such a technology has been disclosed, for example, in Japanese Patent Application Laid-Open No. 2001-27863.

In the above technology, although abnormality of the thermistor can be detected in a short time just after turning on the power of the image forming apparatus, abnormality of the thermistor cannot be detected in a short time at other times. Thus, there is a need of a technology that can detect abnormality of the thermistor in a short time even at other times.

SUMMARY OF THE INVENTION

It is an object of the present invention to solve the problems in the conventional technology at least partially.

According to an aspect of the present invention, there is provided an image forming apparatus including a fixing unit that fixes a toner image on a sheet by heating the sheet; a temperature detecting unit that detects temperature of the fixing unit; and a control unit that monitors temperatures detected by the temperature detecting unit and determines that the temperature detecting unit is abnormal when a first difference in temperatures in a first time period exceeds a first threshold.

According to another aspect of the present invention, there is provided an image forming method including fixing a toner image on a sheet with a fixing unit by heating the sheet; detecting temperature of the fixing unit with temperature detecting unit; and monitoring temperatures detected at the detecting and determining that the temperature detecting unit is abnormal when a first difference in temperatures in a first time period exceeds a first threshold.

According to still another aspect of the present invention, there is provided a computer program product comprising a computer usable medium having computer readable program codes embodied in the medium that, when executed, causes a computer to execute the above method.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained below with reference to the accompanying drawings.

Figure 1:
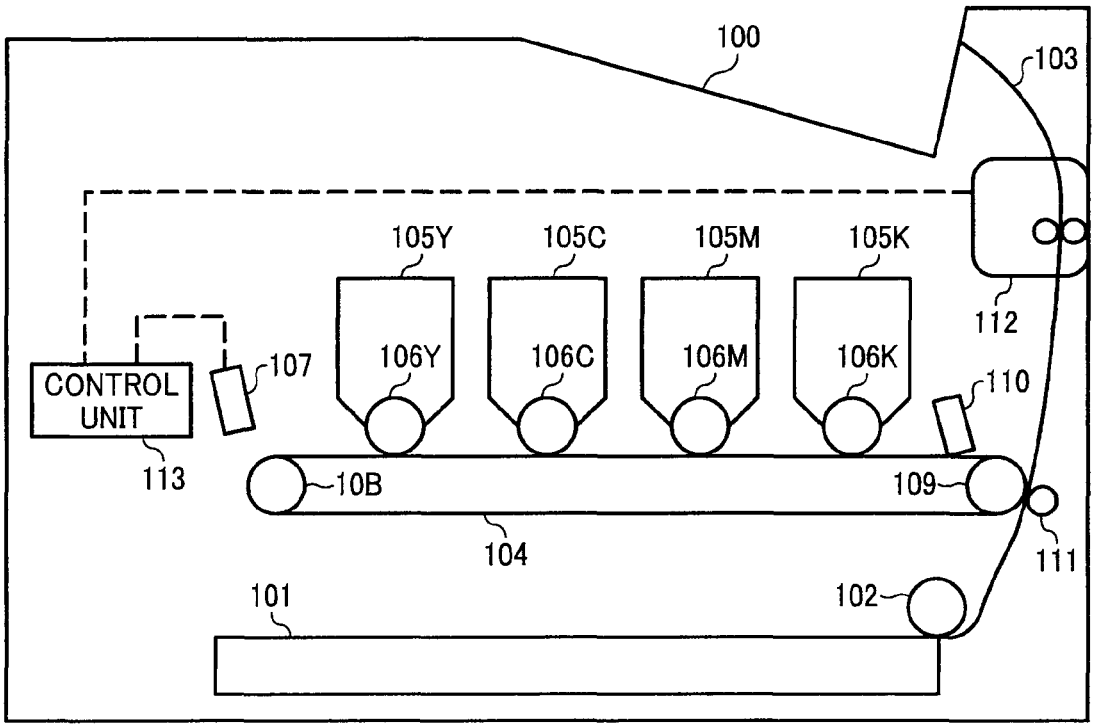
FIG. 1 is a schematic diagram of an image forming apparatus according to an embodiment of the present invention.
Figure 2:
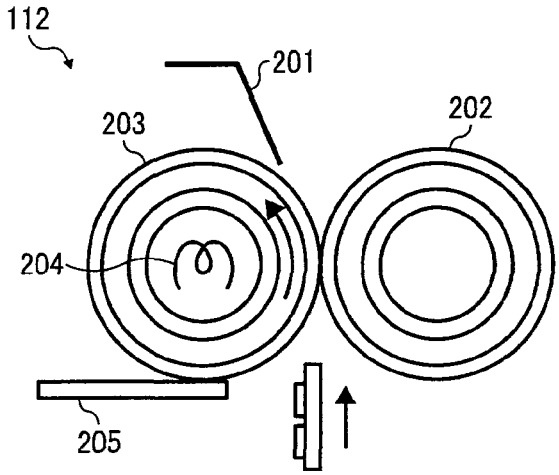
FIG. 2 is a schematic diagram of a fixing unit shown in FIG. 1.

FIG. 1 is a schematic diagram of an image forming apparatus 100 according to an embodiment of the present invention, and FIG. 2 is a schematic diagram of a fixing unit 112 shown in FIG. 1.

The image forming apparatus 100 includes a cassette 101; a feeding roller 102; a conveying path 103; an intermediate transfer belt 104; developing units 105K, 105C, 105M, and 105Y for four colors of black (K), magenta (M), cyan (C), and yellow (Y); photosensitive elements 106K, 10C, 106M, and 106Y for the four colors; a sensor 107, a tension roller 108; a driving roller 109; a cleaning unit 110; a secondary transfer roller 111; and the fixing unit 112.

The cassette 101 accommodates blank sheets. The feeding roller 102 picks up the sheets in the cassette 101 one by one from the uppermost sheet in order. The sheet picked up by the feeding roller 102 is conveyed to the secondary transfer roller 111 through the conveying path 103 while being synchronized with the movement of the intermediate transfer belt 104 so that an image formed on the intermediate transfer belt 104 is transferred onto the sheet appropriately. The intermediate transfer belt 104 is supported by the driving roller 109 and the tension roller 108 so that the intermediate transfer belt 104 is rotated by the driving force through the driving roller 109 and is prevented from sagging by the tension roller 108.

The image forming apparatus 100 is a tandem type image forming apparatus, in which the developing units 105K, 105C, 105M, and 105Y are aligned along the intermediate transfer belt 104. The developing units 105K, 105C, 105M, and 105Y include the photosensitive elements 106K, 10C, 106M, and 106Y, respectively, for carrying toner images of respective colors.

The intermediate transfer belt 104 rotates counterclockwise, and the developing units 105K, 105C, 105M, and 105Y are aligned in this order from upstream side in a rotation direction of the intermediate transfer belt 104. The configuration of each of the developing units 105K, 105C, 105M, and 105Y is the same except for the color of the formed toner image. In the explanation below that is common to all of the developing units 105K, 105C, 105M, and 105Y, or all of the photosensitive elements 106K, 10C, 106M, and 106Y, the developing units 105K, 105C, 105M, and 105Y are each called the developing unit 105, and the photosensitive elements 106K, 10C, 106M, and 106Y are each called a photosensitive element 106.

Upon forming image, the surface of the photosensitive element 106 is uniformly charged in the dark, which is then irradiated with laser that corresponds to an image of each color to form a latent image. The latent image is developed, so that a toner image of each color is formed on the photosensitive element 106. The toner image is transferred onto the intermediate transfer belt 104 at the primary transfer position where the photosensitive element 106 is in contact with the intermediate transfer belt 104 by a primary transfer roller (not shown).

For full color printing, the intermediate transfer belt 104 onto which a black toner image is transferred at the developing unit 105K is moved to the developing unit 105M where a magenta toner image formed on the photosensitive element 106M in the same manner as described above is superimposed on the black toner image on the intermediate transfer belt 104. The intermediate transfer belt 104 is further moved to the developing unit 105C and the developing unit 105Y in order, so that a cyan toner image and a yellow toner image are also superimposed in the same manner, whereby a full-color image is formed on the intermediate transfer belt 104. The intermediate transfer belt 104 with the full-color image formed thereon is moved to the secondary transfer roller 111 where the full-color image is transferred onto a sheet. The sensor 107 includes a light emitting element and a photodetector, and reads a pattern image on the intermediate transfer belt 104. After the full-color image is transferred onto the sheet, residual toner remaining on the intermediate transfer belt 104 without being transferred onto the sheet is removed by the cleaning unit 110 to be ready for the next image forming operation.

The fixing unit 112 fuses the full-color image on the sheet by heating and fixes it to the sheet. As shown in FIG. 2, in the fixing unit 112, a heater 204 raises the temperature of a fixing roller 203 while a thermistor 205 managing the temperature change. If the temperature of the fixing roller 203 is equal to or higher than a threshold, the fixing unit 112 performs heating and fixing of the full-color image to the sheet by a pressure roller 202 and the fixing roller 203, which is discharged from the image forming apparatus 100 through a separating plate 201.

Upon forming an image using only a black toner (forming a monochrome image), the photosensitive elements 106M, 10C, and 106Y are retracted, i.e., they are separated from the intermediate transfer belt 104, and the image forming process is performed only for a black toner image.

Figure 3:
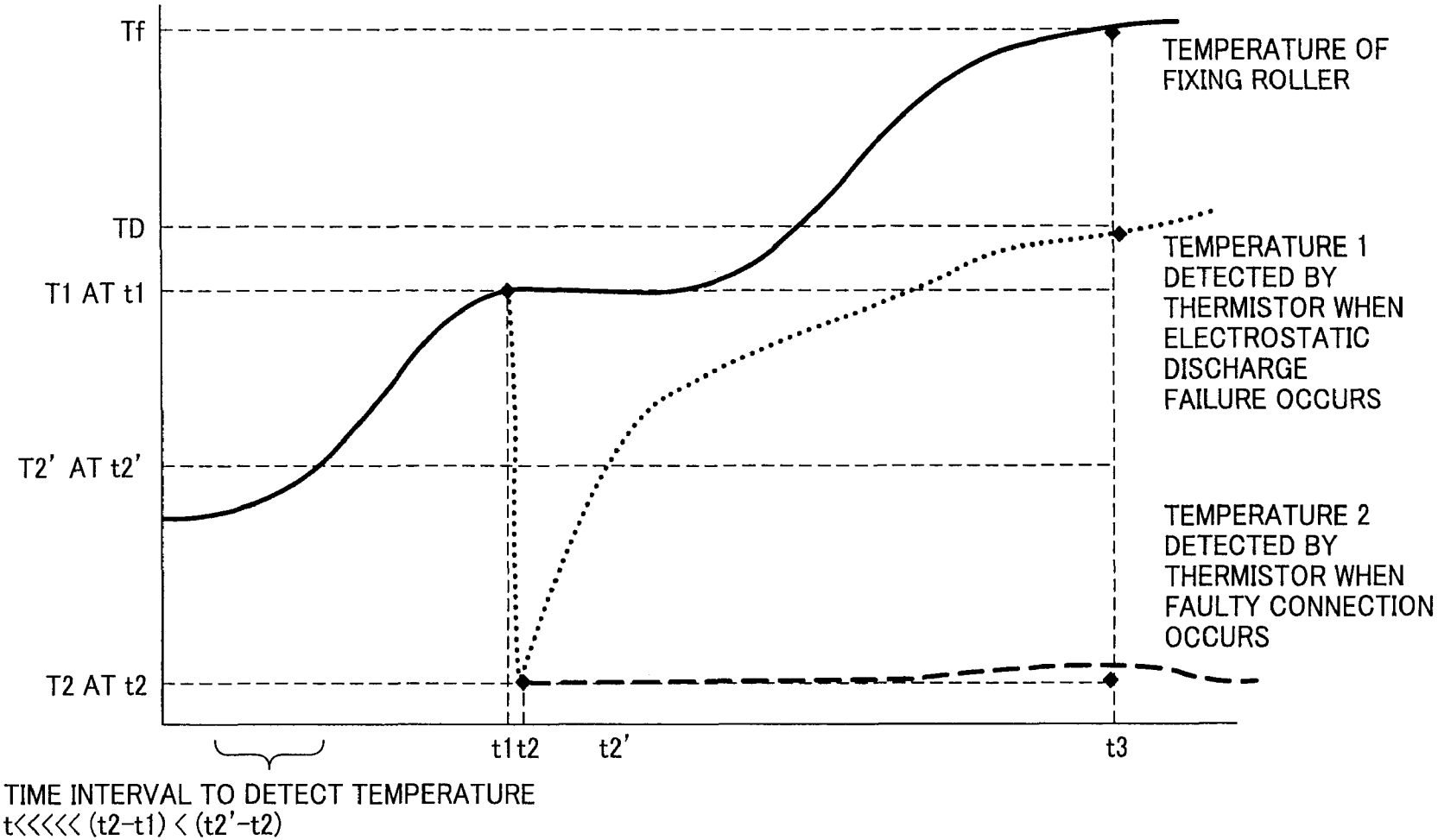
FIG. 3 is a graph representing one example of relation between the temperature detected by a temperature detecting unit and the time.

One example of controlling the temperature detected by the thermistor 205 is explained referring to FIG. 3. FIG. 3 is a graph representing one example of relation between the temperature detected by the thermistor 205 and the time, wherein a vertical axis represents the temperature and a horizontal axis represents the time. In FIG. 3, Tf is abnormal temperature detected by the thermistor 205, and TD is high temperature detected by the thermistor 205.

The image forming apparatus 100 includes a control unit 113 that monitors the temperature of the fixing roller 203 every predetermined time (t) by using the thermistor 205. The control unit 113 is, for example, a microprocessor. If a temperature drop (T2−T1) in a first time period (t2−t1) exceeds a first threshold, the control unit 113 determines that the thermistor 205 is abnormal. Then, if a temperature change (T2'−T2) in a second time period (t2'−t2) is equal to or more than a second threshold, the control unit 113 determines that the thermistor 205 has become abnormal due to electrostatic discharge failure and causes a display unit to display the contents thereof. If the temperature change in the second time period (t21−t2) is less than the second threshold, the control unit 113 determines that the thermistor 205 has become abnormal due to faulty connection and causes a display unit to display the contents thereof.

The image forming apparatus 100 is realized by an image forming program for executing image forming processing by a computer that includes, however not limited to, general-purpose personal computer (PC) and work station. Therefore, the image forming apparatus 100 can be achieved anywhere only by preparing a computer capable of executing the image forming program. The image forming program can be stored in a computer-readable recording medium.

Examples of the recording medium include a computer-readable recording medium such as a compact disc read only memory (CD-ROM), a flexible disk (FD), a compact disk recordable (CD-R), and a digital versatile disk (DVD), a hard disk driver (HDD), and a semiconductor memory such as a flash memory, a random access memory (RAM), a read only memory (ROM), and a ferroelectric RAM.

In this manner, an abnormality of the temperature detecting unit can be detected in a short time even at times other than turning on the power. By stopping the operation of the heater upon detecting that the temperature detecting unit is abnormal, it is possible to prevent excessive increase of the temperature of the fixing unit.

Furthermore, if the temperature detecting unit is abnormal, the fact that the temperature detecting unit is abnormal is displayed on a displaying unit. Therefore, a repairman can replace the abnormal temperature detecting unit with a new one.

According to one aspect of the present invention, an abnormality of the temperature detecting unit in the fixing unit can be detected in a short time.

According to another aspect of the present invention, the causes of the abnormality of the temperature detecting unit can be determined.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a fixing unit that fixes a toner image on a sheet by heating the sheet;

a temperature detecting unit that detects temperature of the fixing unit; and a control unit that monitors temperatures detected by the temperature detecting unit and determines that the temperature detecting unit is abnormal when a first difference in temperatures in a first time period exceeds a first threshold;

wherein the control unit, upon determining that the temperature detecting unit is abnormal, compares a second difference in temperatures with a second threshold, the control unit monitoring the second difference by using the temperature detecting unit after a second time period longer than the first time period passes, and determines a reason of the abnormality of the temperature detecting unit based on a result of comparison.

2. The image forming apparatus according to claim 1, wherein when the second difference is equal to or more than the second threshold, the control unit determines that the reason is electrostatic discharge failure.

3. The image forming apparatus according to claim 1, wherein when the second difference is less than the second threshold, the control unit determines that the reason is faulty connection.

4. The image forming apparatus according to claim 1, further comprising a displaying unit that displays a reason of the abnormality.

5. The image forming apparatus according to claim 4, wherein the displaying unit is a liquid crystal panel.

6. The image forming apparatus according to claim 1, wherein the temperature detecting unit is a thermistor.

7. An image forming method comprising:

fixing a toner image on a sheet with a fixing unit by heating the sheet;

detecting temperature of the fixing unit with temperature detecting unit; and monitoring temperatures detected at the detecting and determining that the temperature detecting unit is abnormal when a first difference in temperatures in a first time period exceeds a first threshold;

wherein upon determining that temperature detecting unit is abnormal, the monitoring includes comparing a second difference in temperatures with a second threshold, the monitoring includes monitoring the second difference by using the temperature detecting unit after a second time period longer than the first time period passes, and determining a reason of the abnormality of the temperature detecting unit based on a result of comparison.

8. The image forming method according to claim 7, wherein when the second difference is equal to or more than the second threshold, the monitoring includes determining that the reason is electrostatic discharge failure.

9. The image forming method according to claim 7, wherein when the second difference is less than the second threshold, the monitoring includes determining that the reason is faulty connection.

10. A computer program product comprising a computer usable medium having computer readable program codes embodied in the medium that, when executed, causes a computer to execute:

fixing a toner image on a sheet with a fixing unit by heating the sheet;

detecting temperature of the fixing unit with temperature detecting unit; and monitoring temperatures detected at the detecting and determining that the temperature detecting unit is abnormal when a first difference in temperatures in a first time period exceeds a first threshold;

wherein upon determining that temperature detecting unit is abnormal, the monitoring includes comparing a second difference in temperatures with a second threshold, the monitoring includes monitoring the second difference by using the temperature detecting unit after a second time period longer than the first time period passes, and determining a reason of the abnormality of the temperature detecting unit based on a result of comparison.

11. The computer program product according to claim 10, wherein when the second difference is equal to or more than the second threshold, the monitoring includes determining that the reason is electrostatic discharge failure.

12. The computer program product according to claim 10, wherein when the second difference is less than the second threshold, the monitoring includes determining that the reason is faulty connection.

13. The computer program product according to claim 10, further comprising displaying a reason of the abnormality on a displaying unit.

14. The computer program product according to claim 13, wherein the displaying unit is a liquid crystal panel.

15. The computer program product according to claim 10, wherein the temperature detecting unit is a thermistor.

* * * * *